US008919577B2

(12) United States Patent
Nally et al.

(10) Patent No.: US 8,919,577 B2
(45) Date of Patent: Dec. 30, 2014

(54) BOCCE BALL GAME CADDY

(71) Applicant: EastPoint Sports Ltd., LLC, Whippany, NJ (US)

(72) Inventors: Michael J. Nally, Whippany, NJ (US); Adam B. Abramson, Oxford, NJ (US); James P. Burns, Cranford, NJ (US)

(73) Assignee: EastPoint Sports Ltd., LLC, Whippany, NJ (US)

( * ) Notice: Subject to any disclaimer, the term of this patent is extended or adjusted under 35 U.S.C. 154(b) by 0 days.

(21) Appl. No.: 13/781,197

(22) Filed: Feb. 28, 2013

(65) Prior Publication Data

US 2014/0238946 A1 Aug. 28, 2014

(51) Int. Cl.
*A47F 7/00* (2006.01)
*A63B 47/00* (2006.01)

(52) U.S. Cl.
CPC ..... *A63B 47/00* (2013.01)
USPC ..... 211/14; 211/85.7

(58) Field of Classification Search
CPC ..... A63B 47/00; A63B 47/007
USPC ..... 206/315.6; 211/14, 85.7, 85.26, 13.1, 211/15; 248/129
See application file for complete search history.

(56) References Cited

U.S. PATENT DOCUMENTS

| | | | | | |
|---|---|---|---|---|---|
| 2,074,180 | A | * | 3/1937 | Hatley | 224/248 |
| 2,570,504 | A | * | 10/1951 | Van House | 280/47.19 |
| 3,873,009 | A | * | 3/1975 | Goudreau | 224/247 |
| 4,062,482 | A | * | 12/1977 | Szalony | 224/247 |
| 4,214,684 | A | * | 7/1980 | Galowitz | 294/161 |
| D330,061 | S | * | 10/1992 | Hilbert | D34/27 |
| 5,480,026 | A | | 1/1996 | Darling et al. | |
| 5,931,483 | A | * | 8/1999 | Haynes | 280/47.19 |
| 6,099,023 | A | * | 8/2000 | Be | 280/655 |
| D487,911 | S | | 3/2004 | Cheney | |
| 6,719,306 | B2 | * | 4/2004 | White | 280/47.26 |
| 6,723,013 | B2 | | 4/2004 | Ilcisin et al. | |
| D512,564 | S | * | 12/2005 | Teitloff et al. | D3/258 |
| D563,099 | S | | 3/2008 | Sandman | |
| 7,500,570 | B2 | * | 3/2009 | Kurcheski | 211/14 |
| 7,789,250 | B2 | | 9/2010 | Aamodt | |
| 7,997,594 | B1 | * | 8/2011 | Mortazavi et al. | 280/47.26 |
| D663,368 | S | | 7/2012 | Denner | |
| 2002/0113386 | A1 | * | 8/2002 | Be | 280/47.19 |
| 2005/0115849 | A1 | | 6/2005 | Nally | |
| 2006/0267286 | A1 | | 11/2006 | Hickey | |
| 2006/0287145 | A1 | | 12/2006 | Liao | |
| 2010/0018936 | A1 | | 1/2010 | Di Donato | |
| 2010/0112254 | A1 | | 5/2010 | Data | |
| 2013/0026310 | A1 | * | 1/2013 | Belcourt-McCabe | 248/125.1 |

FOREIGN PATENT DOCUMENTS

| | | |
|---|---|---|
| FR | 1249649 | 2/1960 |
| FR | 1379805 | 10/1963 |
| FR | 2568481 | 8/1984 |
| FR | 2853842 | 4/2003 |
| FR | 2858564 | 8/2003 |
| FR | 2905281 | 9/2006 |

* cited by examiner

*Primary Examiner* — Korie H Chan
(74) *Attorney, Agent, or Firm* — Thomas J. Oppold; Larkin Hoffman Daly & Lindgren, Ltd.

(57) ABSTRACT

A bocce ball game caddy for removably retaining bocce ball game components. The caddy includes a plurality of racks supported by posts in vertically spaced relation. Each of the racks supporting at least one retainer adapted to removably support the bocce ball game components.

25 Claims, 8 Drawing Sheets

BOCCE BALL GAME CADDY

BACKGROUND

The game of bocce ball is typically played as a backyard lawn game. It can be played in many different ways, but is usually played with teams, with one, two or four players per team. A typical bocce ball game set consists of eight large bocce balls (two pairs of four balls, with each pair having a different color or pattern) and a smaller "pallina" ball, (sometimes called a "jack"), which is typically colored white. The object of bocce ball is to try to roll the bocce balls closer to the pallina than the opposing team. Typically, one player on a team starts the game by throwing the pallina, and then that player rolls the first bocce ball trying to get it as close to the pallina as possible. Each player on the opposing team then rolls his/her bocce ball until all four balls are played. After the opposing team plays all of their balls, each player on the starting team then rolls the remaining bocce balls, trying to get closer to the pallina than the opponent's closest bocce ball. Alternatively, the players on opposing teams may take turns rolling their respective balls. When all the bocce balls have been played (which completes a frame), one point is awarded to the team for each of its bocce balls which are closer to the pallina than the closest ball of the opponent's closest bocce ball. The team that scores in a frame starts the next frame by throwing the pallina and playing the first bocce ball. Play continues until a team wins by reaching a score of sixteen points or some other predetermined point total.

There is a need for a caddy that may be used for carrying and storing a set of bocce ball game components in a convenient manner which will keep all of the game components together.

DESCRIPTION

Figure 1:
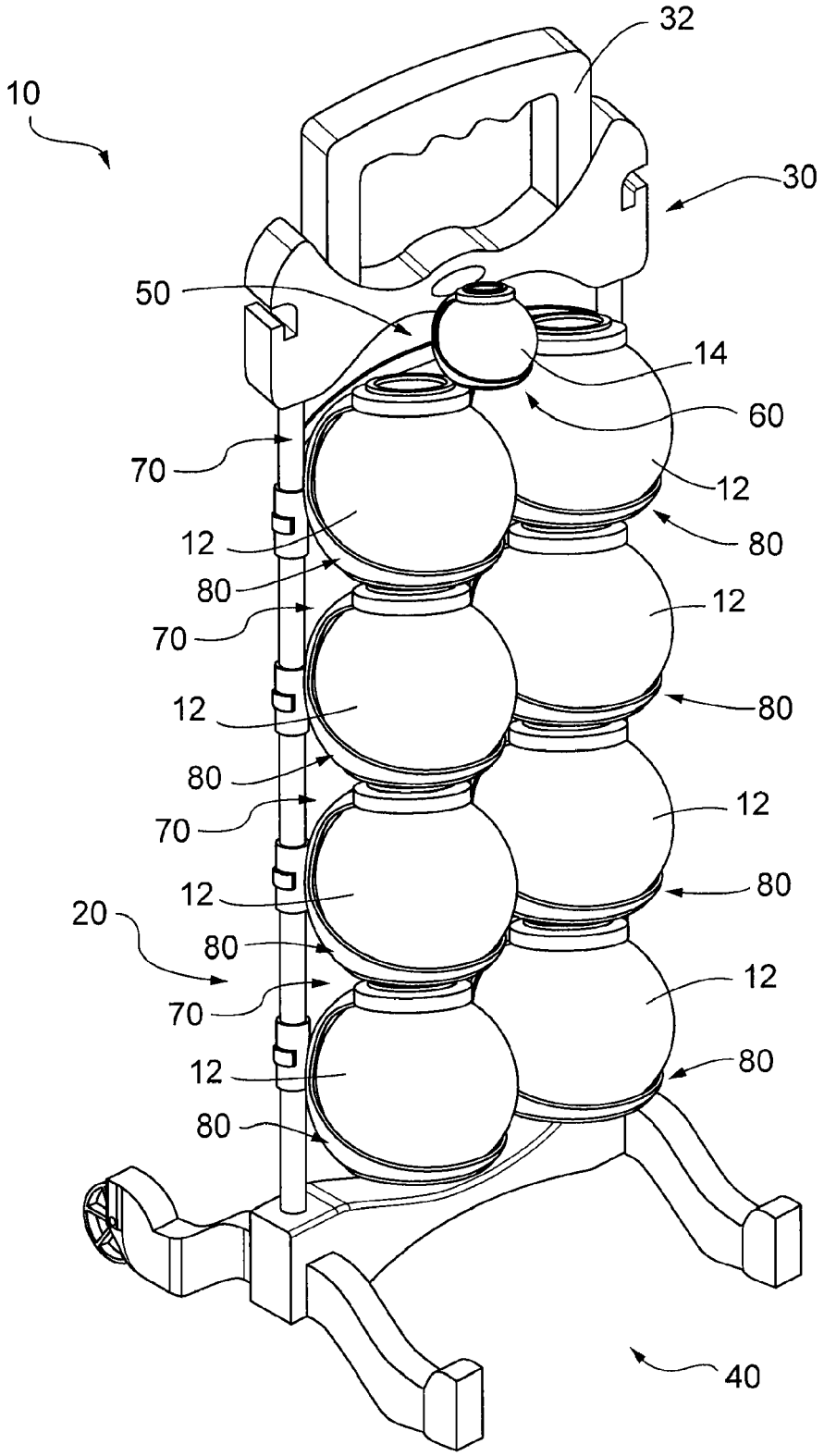
FIG. 1 is a front perspective view of one embodiment of a bocce ball game caddy holding a complete set of bocce ball game components.
Figure 2:
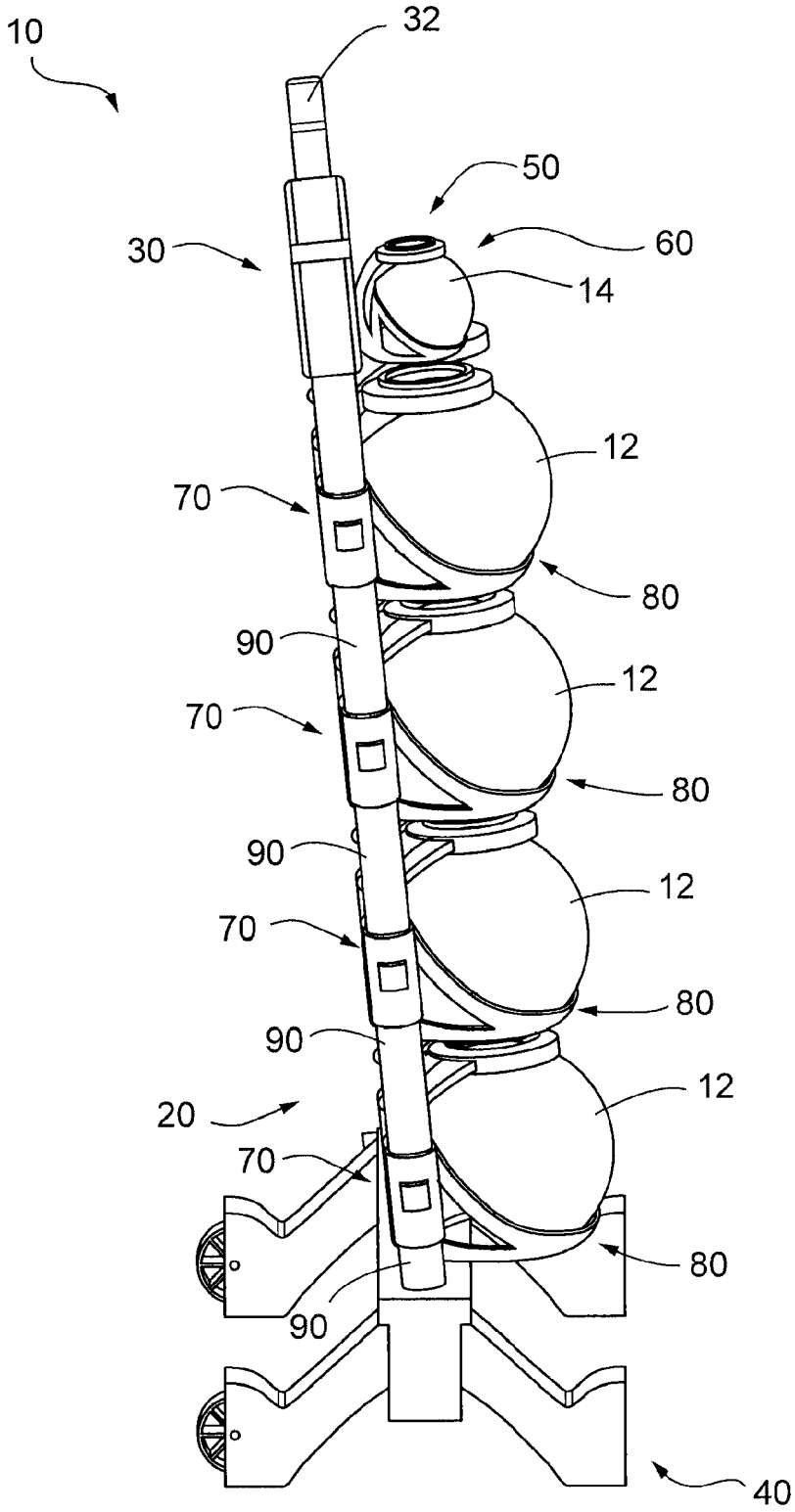
FIG. 2 is a left sided elevation view of the bocce ball game caddy of FIG. 1
Figure 3:
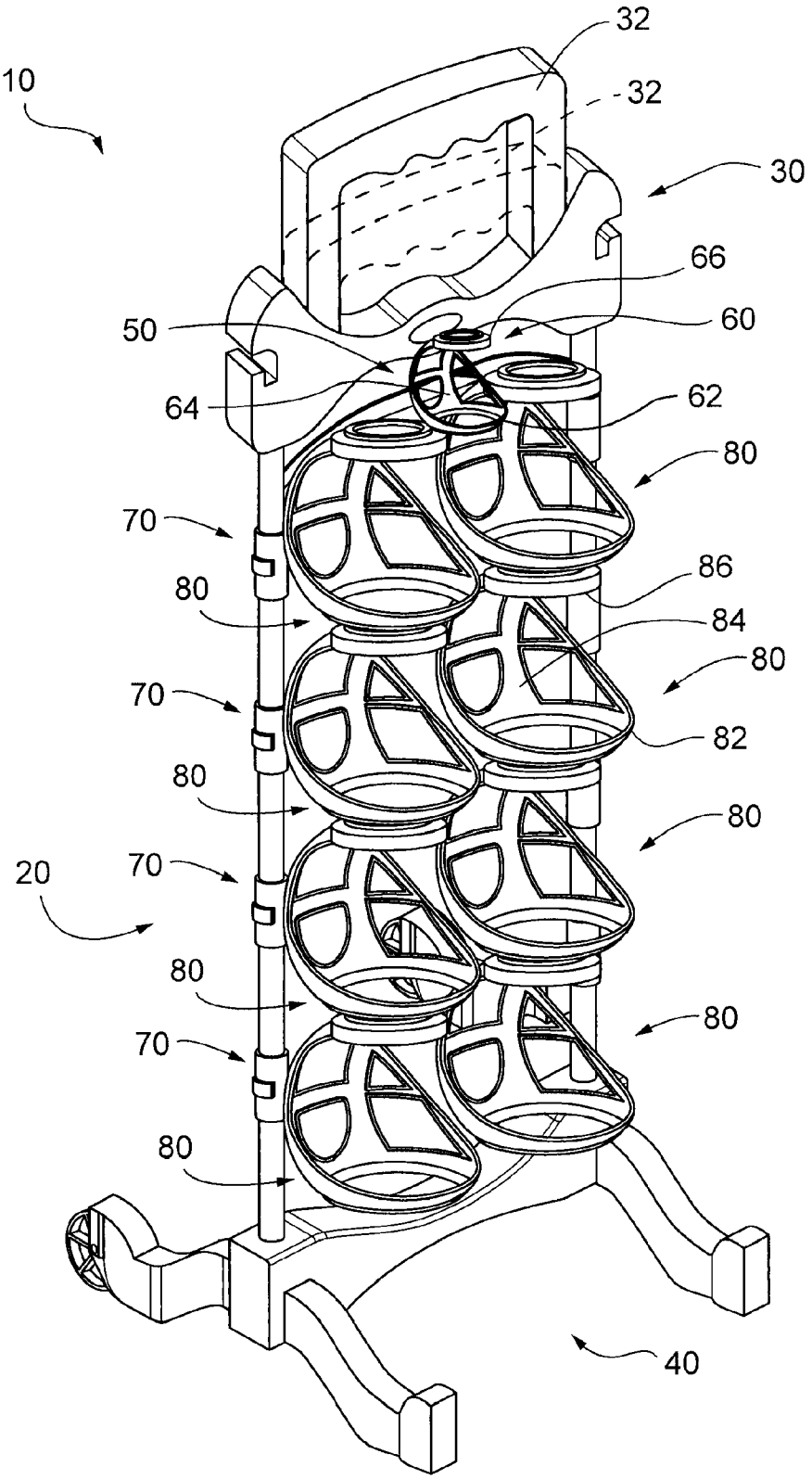
FIG. 3 is a front perspective view of the bocce ball caddy of FIG. 1 with the bocce ball game components removed.
Figure 4:
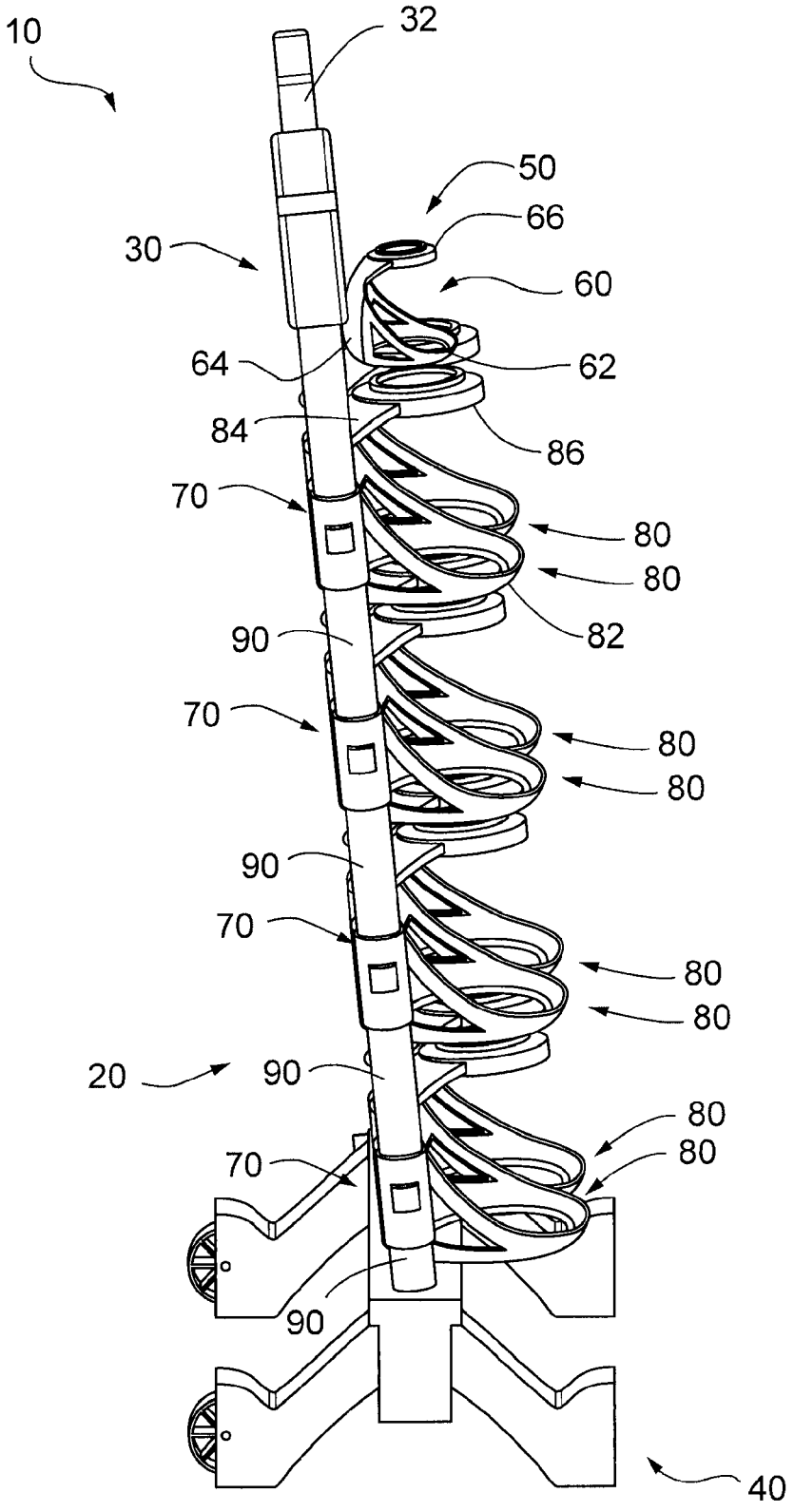
FIG. 4 is a left sided elevation view of the bocce ball caddy of FIG. 3.
Figure 5:
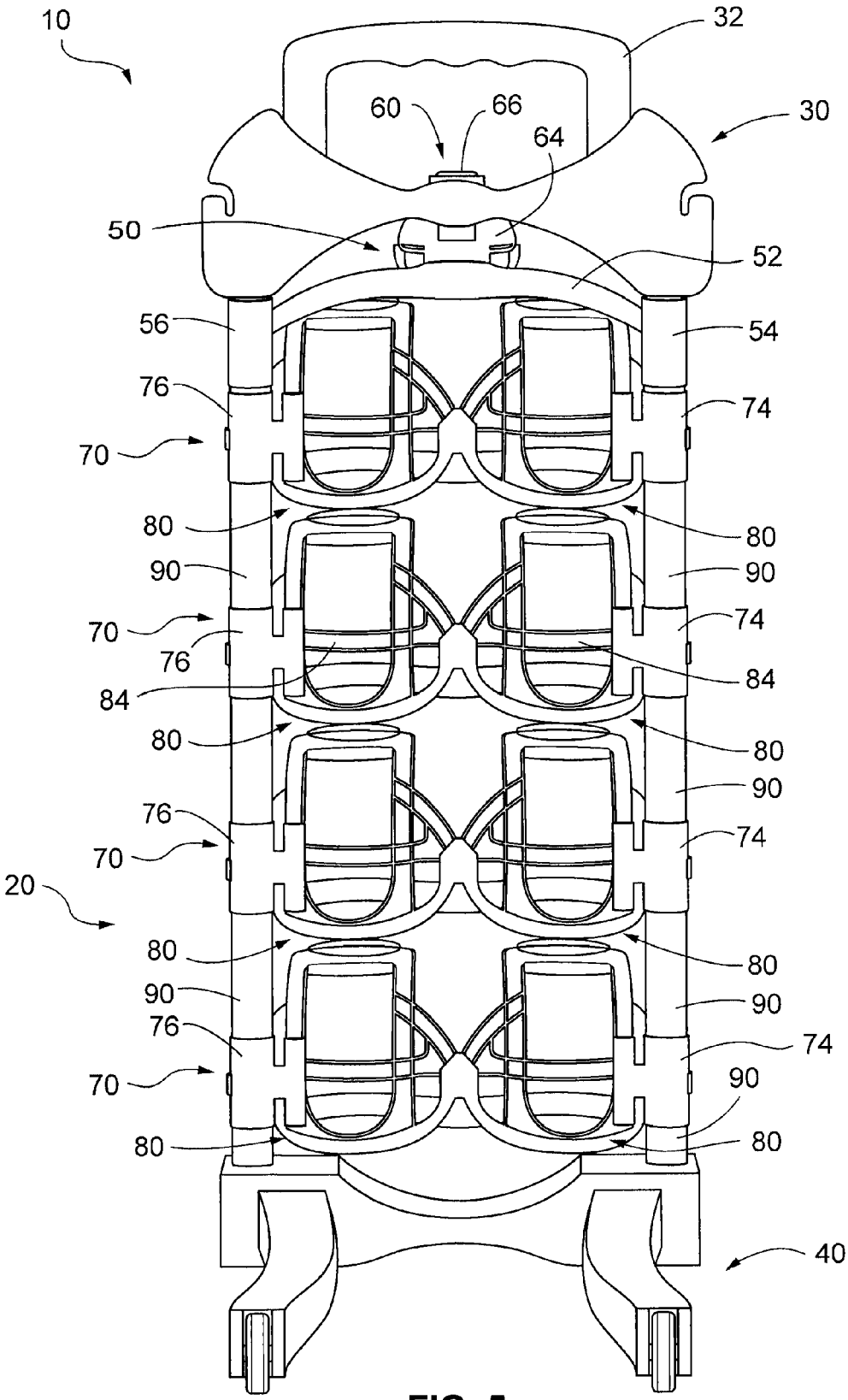
FIG. 5 is a rear elevation view of the bocce ball game caddy of FIG. 3.

Referring to the drawing figures, wherein like reference numerals designate the same or corresponding parts throughout the several views, FIG. 1 is a perspective view of one embodiment of a bocce ball game caddy 10. In FIG. 1, the bocce ball game caddy 10 is shown holding the bocce ball game components, which typically includes eight large bocce balls 12 (two pairs of four balls, with each pair having a different color or pattern) and a smaller pallina ball 14. FIG. 2 is a left side elevation view of FIG. 1. FIGS. 3 and 4 are the same perspective views of the caddy of FIGS. 1 and 2, but with the bocce balls 12 and pallina 14 removed for clarity to better view the elements of the caddy 10. FIG. 5 is a rear elevation view of the bocce ball game caddy of FIG. 3.

Figure 7:
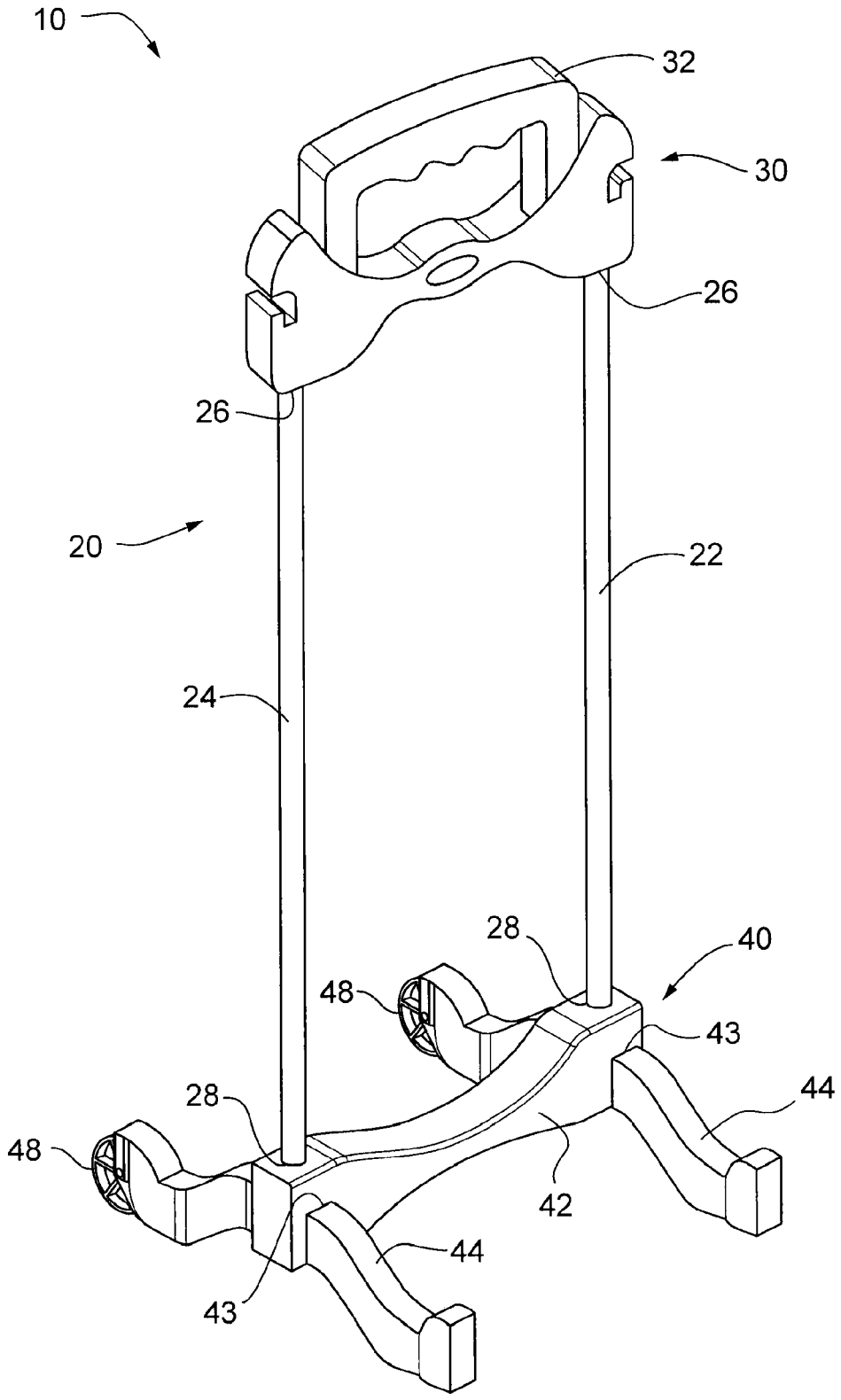
FIG. 7 is a perspective view of the frame of the bocce ball caddy of FIG. 1.

Referring to FIG. 7, the caddy 10 comprises a main frame 20 which includes two substantially parallel posts 22, 24, a handle support 30 and a base 40. Comparing FIGS. 3 and 7, and as described in more detail below, it can be seen that the posts 22, 24 operably support the pallina rack 50 and a plurality of bocce ball racks 60 which are spaced vertically along the posts 22, 24 by intermediate spacers 90.

The posts 22, 24 are constructed of material that is sufficiently rigid to support the weight of the game components during transport, but yet are preferably lightweight to minimize the overall weight of the caddy 10 to reduce shipping costs and so that it is more easily transportable by players of all ages. For example, the posts 22, 24 may be constructed of thin walled hollow metal tubing or other sufficiently rigid, lightweight material of a desired cross-sectional configuration. The posts 22, 24 are received within bores 26 disposed on the underside of the handle support 30 and bores 28 disposed on the top side of the base 40. The posts 22, 24 may be retained in the bores 26, 28 by tapping screws (not shown).

The handle support 30 serves as a lateral brace for the upper end of the frame 20 and may be constructed of any suitably rigid and preferably lightweight material such as thermoformed plastic or other desirable material. The handle support 30 includes a handle grip 32 which may be telescopically received within the handle support 30 such that the handle grip 32 may move between an upwardly extended position and a downwardly collapsed position (as shown in dashed lines in FIG. 3). In the upwardly extended position, the handle grip 32 is sufficiently raised to an elevation that avoids or reduces the need for a player to bend over or lean when pulling the caddy 10. The downwardly collapsed position provides the advantage of permitting the caddy 10 to be shipped in a shorter box than if the handle was fixed in the fully extended position. Thus, while a telescoping handle as embodied herein provides ergonomic advantages while pulling the caddy and the advantage of being able to ship the caddy in a shorter box, it should be appreciated that the handle grip 32 need not be telescoping and may be fixedly attached or formed integral with the handle support 30.

Figure 8:
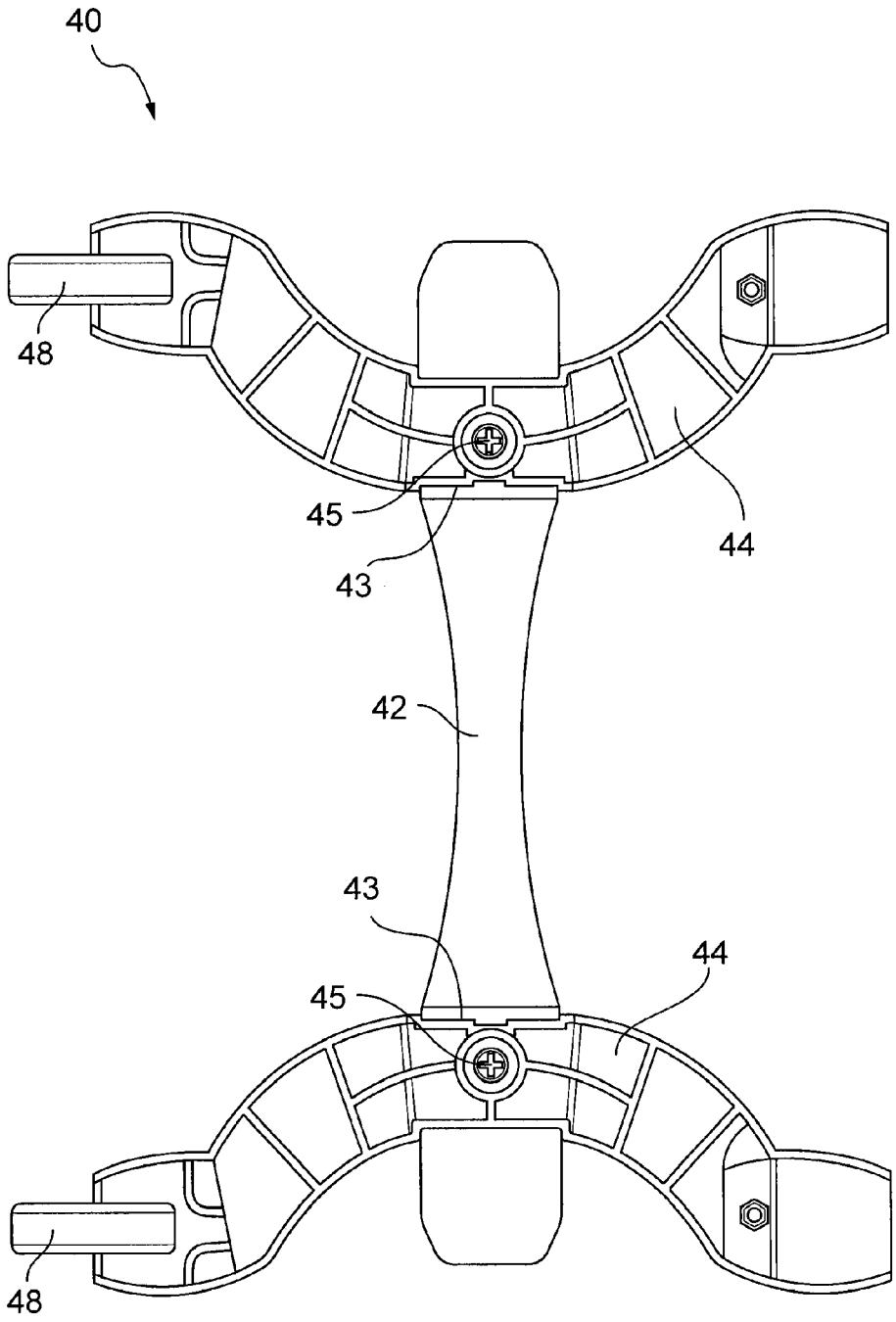
FIG. 8 is a bottom plan view of one embodiment of the base of the frame of FIG. 6.

The base 40 includes a laterally extending cross-member 42 and a pair of fore and aft extending legs 44 secured to the underside of the cross-member 42 to stabilize and support the caddy in an upright position such that it does not easily tip over. As identified in FIGS. 7 and 8, the cross-member 42 includes recesses 43 into which the legs 44 are received and secured in place by a threaded connector 45 (FIG. 8). Alternatively, the legs 44 and the lateral brace 42 may be molded or otherwise formed as a unitary member. One end of the legs 44 support rollers or wheels 48 or alternatively one end of the legs 44 may support a wheeled axle extending between the legs so that the caddy may be pulled behind a player as he or she walks so the player does not need to lift and carry the caddy 10 which, when fully loaded with a complete set of bocce ball game components, can be quite heavy for younger players.

Figure 6:
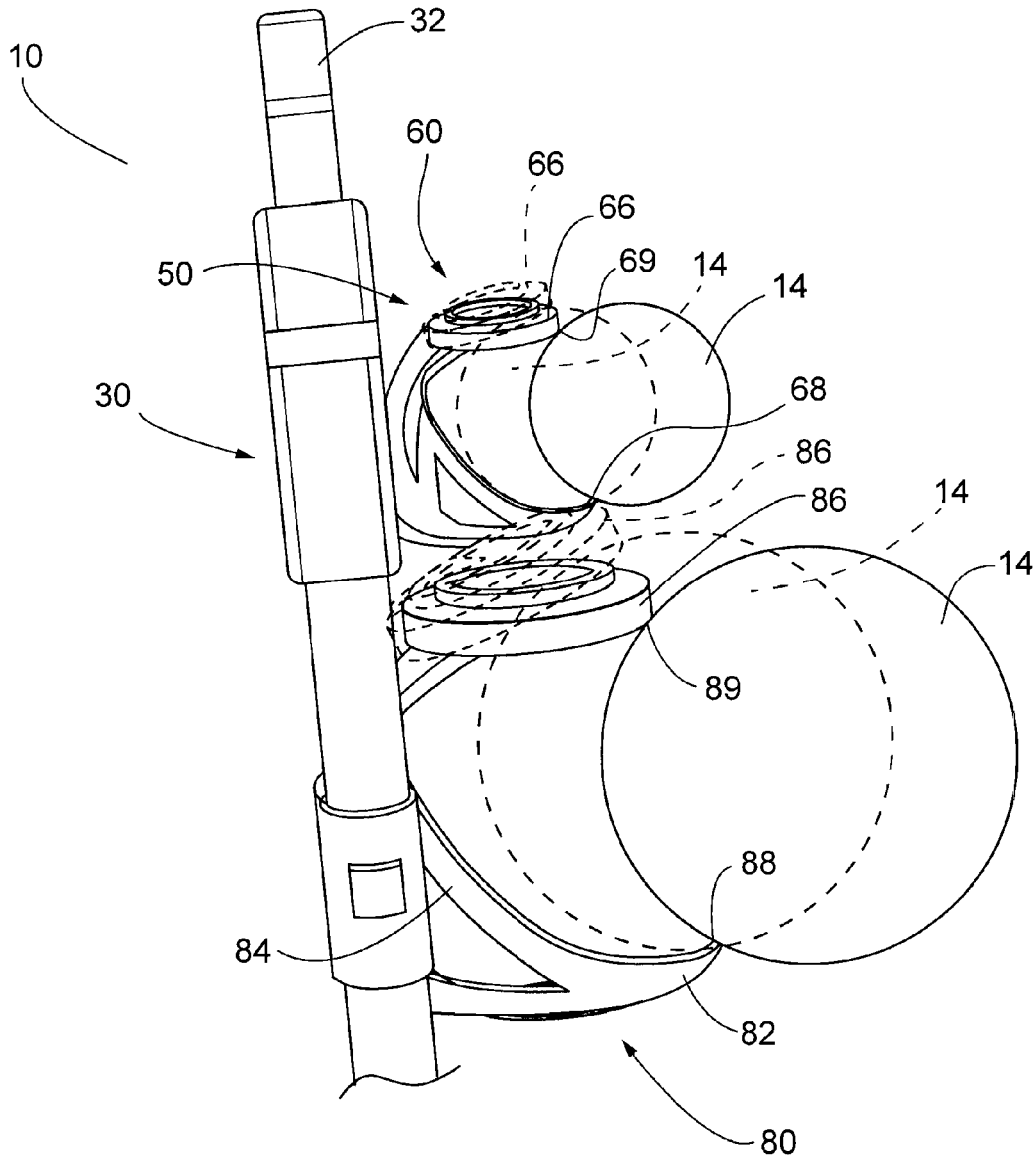
FIG. 6 is an enlarged side elevation view of the bocce ball caddy showing the pallina and bocce balls being removed or inserted into their respective retainers.

As best viewed in FIGS. 3-6, disposed at the upper end of the frame 20 is the pallina rack 50. The pallina rack 50 includes a crossbeam 52 bridging between tubular sleeves 54, 56 received over the posts 22, 24. Attached in the middle of the crossbeam 52 is a pallina retainer 60. The pallina retainer 60 is configured to securely hold the pallina 14 while the caddy 10 is being transported, but yet allows the pallina 14 to be easily removed when desired. To accomplish such functionality, one embodiment of the pallina retainer 60 comprises a bottom segment 62, a back segment 64 and a front segment 66. Each of the segments 62, 64, 66 define a convex interior volume or surface area which is slightly larger than the pallina 14. As best illustrated in FIG. 6, the vertical distance between opposing edges 68, 69 of the bottom and top segments 62, 66 is less than the diameter of the pallina 14 such that when inserting the pallina 14 into the pallina retainer 60, the pallina needs to be pushed with sufficient force to cause the top segment 66 to bend upwardly, or to otherwise cause both the top and bottom segments 66, 62 to separate sufficiently to receive the pallina. Likewise when the pallina is removed from the pallina retainer 60, the pallina needs to be grasped and pulled with sufficient force to cause the top segment 66 to bend upwardly, or otherwise cause the the top and bottom segments 66, 62 to sufficiently separate to remove the pallina from the retainer 60. Thus, it should be appreciated that when the pallina 14 is received within the pallina retainer 60, the bottom, back and top segments 62, 64, 66 extend sufficiently around the outer surface of the pallina such that the pallina is securely yet removably received within the convex interior volume or spherical surface area of the retainer 60 so that the pallina is longitudinally and laterally restrained within the retainer 60 so the pallina cannot fall out during transport.

Continuing to refer to FIGS. 3-6, disposed below the pallina rack 50 are a plurality of bocce ball racks 70 vertically spaced along the frame 20 by tubular spacers 90 received over the posts 22, 24. Each bocce ball rack 70 includes tubular sleeves 74, 76 which receive the posts 22, 24 attached between the sleeves 74, 76 are a pair of bocce ball retainers 80. Like the pallina retainer 60, each bocce ball retainer 80 is configured to securely hold a bocce ball 12 while the caddy 10 is being transported, but yet each retainer 80 allows the bocce ball 12 to be easily removed when desired. Similar to the pallina retainer 60, the bocce ball 80 retainer may comprise a bottom segment 82, a back segment 84 and a front segment 86 which together define a convex interior volume or surface area which is slightly larger than the bocce ball 12. As best illustrated in FIG. 6, the vertical distance between opposing edges 88, 89 of the bottom and top segments 82, 86 is less than the diameter of the bocce ball 12 such that when inserting the bocce ball 12 into the bocce ball retainer 80, the bocce ball needs to be pushed with sufficient force to cause the top segment 86 to bend upwardly, or to otherwise cause both the top and bottom segments 86, 82 to separate sufficiently to receive the bocce ball. Likewise when the bocce ball is removed from the bocce ball retainer 80, the bocce ball needs to be grasped and pulled with sufficient force to cause the top segment 86 to bend upwardly, or otherwise cause the the top and bottom segments 86, 82 to sufficiently separate to remove the bocce ball from the retainer 80. Thus, it should be appreciated that when the bocce ball 12 is received within the bocce ball retainer 80, the bottom, back and top segments 82, 84, 86 extend sufficiently around the outer surface of the bocce ball such that the bocce ball is securely yet removably received within the convex interior volume or spherical surface area of the retainer 80 so that the bocce ball is longitudinally and laterally restrained within the retainer 80 so the bocce ball cannot fall out during transport.

It should be appreciated, that the caddy 10 may have the pallina retainer and bocce ball retainers arranged in any desirable configuration. For example the pallina retainer 60 may be disposed at the bottom of the frame 20 or in the middle of the frame 20 as opposed to being located at the top of the frame as shown in the drawing figures. It should also be appreciated, that rather than having the bocce ball retainers 70 configured with two bocce ball retainers 80 per row, the bocce ball racks may be configured to have two rows with four retainers 80 per row, or the racks 70 may be configured to have two rows with two retainers 80 back to back per row such that some retainers project forwardly and some retainers project rearwardly of the frame 20. In yet another embodiment, the caddy 10 may be configured to have eight rows with one retainer 80 per row or any other desired configuration. In still another embodiment, the pallina rack 50 may be eliminated and the pallina retainer 60 may be supported by one or more of the bocce ball racks 70.

It should also be appreciated that the pallina retainer 60 and bocce ball retainers 80 are preferably made from a material that is sufficiently resilient to allow the respective top and bottom segments 66, 62; 86, 82 to sufficiently separate to insert or remove the respective balls but yet remain sufficiently rigid to support the weight of the respective balls and to restrain the balls during transport. For example, the retainers 60, 80 may be made of plastic or other suitable material with resilient properties. Additionally, the retainer segments may be configured with openings or a lattice structure as shown in the drawing figures to reduce the amount of material required for the retainers and to minimize or avoid debris or water from collecting in the interior volume or surface areas of the retainers. Furthermore, configuring the retainer segments with openings or with a lattice structure, the top and bottom segments of the retainers are sufficiently rigid yet resilient enough to securely hold the balls 12, 14 while the caddy 10 is being transported, while allowing the balls to be inserted and removed without having to apply undue force.

Various modifications to the embodiments of the apparatus, and the general principles and features of the embodiments described herein will be readily apparent to those of skill in the art. Thus, the present invention is not to be limited to the embodiments described above and illustrated in the drawing figures, but is to be accorded the widest scope consistent with the spirit and scope of the appended claims.

The invention claimed is:

1. In combination, a bocce ball game caddy with a pallina ball and eight bocce balls, the caddy, comprising:

a frame having laterally spaced posts extending substantially vertically upward from a base, said base comprising a pair of legs extending fore and aft of said posts with one end of said pair of legs supporting wheels such that the caddy is rollable in said fore or aft direction;

a pallina rack supported by said posts and having a pallina retainer sized to securely yet removably receive the pallina;

a plurality of vertically spaced bocce ball racks supported by said posts, each bocce ball rack supporting bocce ball retainers, each bocce ball retainer sized and spaced horizontally and vertically on said racks from adjacent ones of said bocce ball retainers such that each of the bocce balls is securely yet independently removably received within one of said bocce ball retainers without interference with an adjacent one of the bocce balls;

said pallina retainer spaced with respect to said bocce ball retainers such that the pallina is independently removably received within said pallina retainer without interference with the bocce balls received within the bocce ball retainers.

2. The combination of claim 1 wherein the pallina and the plurality of bocce balls are longitudinally and laterally restrained within said respective retainers so the balls remain in said respective retainers during transport of the caddy.

3. The combination of claim 1 wherein said pallina retainer includes a bottom segment, a back segment and a top segment which define a convex interior volume which is slightly larger than the pallina, and wherein each of said bocce ball retainers includes a bottom segment, a back segment and a top segment which define a convex interior volume or surface area which is slightly larger than the bocce balls.

4. The combination of claim 3 wherein at least said top segment of said pallina retainer and at least said top segment of each of said bocce ball retainers is resilient.

5. The combination of claim 4 wherein a vertical distance between opposing edges of said top segment and said bottom segment of said pallina retainer is less than a diameter of the pallina such that when inserting or removing the pallina into or from said pallina retainer, said top and bottom segments sufficiently resiliently separate to allow the pallina to pass therebetween.

6. The combination of claim 3 wherein a vertical distance between opposing edges of said top segment and said bottom segment of each of said bocce ball retainers is less than a diameter of the bocce balls such that when inserting or removing the bocce balls into or from each of said bocce ball retainers, said top and bottom segments sufficiently resiliently separate to allow the bocce balls to pass therebetween.

7. The combination of claim 1, further comprising a handle grip.

8. The combination of claim 7, wherein said handle grip is movable between an upwardly extended position and lower collapsed position.

9. In combination, a bocce ball game caddy with a pallina ball and eight bocce balls, the caddy, comprising:

a frame having laterally spaced posts extending substantially vertically upward from a base, said base comprising a pair of legs extending fore and aft of said posts with one end of said pair of legs supporting wheels such that the caddy is rollable in said fore or aft direction;

a pallina rack supported by said posts and having a pallina retainer, said pallina retainer having a bottom segment, a back segment and a top segment which define a convex interior volume which is slightly larger than the pallina;

a plurality of vertically spaced bocce ball racks supported by said posts, each bocce ball rack supporting bocce ball retainers, each of said bocce ball retainers spaced horizontally and vertically on said racks from adjacent ones of said bocce ball retainers such that each of the bocce balls is securely yet independently removably received within one of said bocce ball retainers without interference with an adjacent one of the bocce balls, each of said bocce ball retainers having a bottom segment, a back segment and a top segment which define a convex interior volume which is slightly larger than the bocce balls;

said pallina retainer spaced with respect to said bocce ball retainers such that the pallina is independently removably received within said pallina retainer without interference with the bocce balls received within the bocce ball retainers.

10. The combination of claim 9 wherein said bottom segment, back segment and top segment of said pallina retainer cooperate to longitudinally and laterally restrain the pallina so the pallina remains in said pallina retainer during transport of the caddy.

11. The combination of claim 9 wherein the bottom segment, back segment and top segment of each of said bocce ball retainers cooperate to longitudinally and laterally restrain the bocce balls so the bocce balls remain in said respective bocce ball retainers during transport of the caddy.

12. The combination of claim 10 wherein at least said top segment of said pallina retainer is resilient.

13. The combination of claim 11 wherein at least said top segment of each of said bocce ball retainers is resilient.

14. The combination of claim 10 wherein a vertical distance between opposing edges of said top segment and said bottom segment of said pallina retainer is less than a diameter of the pallina such that when inserting or removing the pallina into or from said pallina retainer, said top and bottom segments sufficiently resiliently separate to allow the pallina to pass therebetween.

15. The combination of claim 11 wherein a vertical distance between opposing edges of said top segment and said bottom segment of each of said bocce ball retainers is less than a diameter of the bocce balls such that when inserting or removing the bocce balls into or from each of said bocce ball retainers, said top and bottom segments sufficiently resiliently separate to allow the bocce balls to pass therebetween.

16. The combination of claim 9, further comprising a handle grip.

17. The combination of claim 16, wherein said handle grip is movable between an upwardly extended position and lower collapsed position.

18. In combination, a bocce ball game caddy with a pallina ball and at least eight bocce balls, the caddy, comprising:

a frame having laterally spaced posts extending substantially vertically upward from a base, said base comprising a pair of legs extending fore and aft of said posts with one end of said pair of legs supporting wheels such that the caddy is rollable in said fore or aft direction;

a pallina retainer operably supported by said frame, said pallina retainer sized to securely yet removably receive the pallina;

bocce ball retainers operably supported by said frame, each one of said bocce ball retainers sized and spaced horizontally and vertically from an adjacent one of said bocce ball retainers such that each of the bocce balls is securely yet independently removably received within one of said bocce ball retainers without interference with an adjacent one of the bocce balls;

said pallina retainer spaced with respect to said bocce ball retainers such that the pallina is independently removably received within said pallina retainer without interference with the bocce balls received within the bocce ball retainers.

19. The combination of claim 18 wherein the pallina and the plurality of bocce balls are longitudinally and laterally restrained within said respective retainers so the balls remain in said respective retainers during transport of the caddy.

20. The combination of claim 18 wherein said pallina retainer includes a bottom segment, a back segment and a top segment which define a convex interior volume which is slightly larger than the pallina, and wherein each of said bocce ball retainers includes a bottom segment, a back segment and a top segment which define a convex interior volume or surface area which is slightly larger than the bocce balls.

21. The combination of claim 20 wherein at least said top segment of said pallina retainer and at least said top segment of each of said bocce ball retainers is resilient.

22. The combination of claim 21 wherein a vertical distance between opposing edges of said top segment and said bottom segment of said pallina retainer is less than a diameter of the pallina such that when inserting or removing the pallina into or from said pallina retainer, said top and bottom segments sufficiently resiliently separate to allow the pallina to pass therebetween.

23. The combination of claim 21 wherein a vertical distance between opposing edges of said top segment and said bottom segment of each of said bocce ball retainers is less than a diameter of the bocce balls such that when inserting or removing the bocce balls into or from each of said bocce ball retainers, said top and bottom segments sufficiently resiliently separate to allow the bocce balls to pass therebetween.

24. The combination of claim 18, further comprising a handle grip.

25. The combination of claim 24, wherein said handle grip is movable between an upwardly extended position and lower collapsed position.

* * * * *